US010957154B2

(12) United States Patent
Graboyes et al.

(10) Patent No.: US 10,957,154 B2
(45) Date of Patent: Mar. 23, 2021

(54) INTERACTIVE GAMING SYSTEM AND METHOD OF UTILIZING THE SAME

(71) Applicant: GameCo, LLC, Las Vegas, NV (US)

(72) Inventors: Blaine Goldman Graboyes, Las Vegas, NV (US); Eli Weissman, Brooklyn, NY (US); Jared Torres, Henderson, NV (US)

(73) Assignee: GAMECO, LLC, Las Vegas, NV (US)

( * ) Notice: Subject to any disclaimer, the term of this patent is extended or adjusted under 35 U.S.C. 154(b) by 0 days.

(21) Appl. No.: 16/367,288

(22) Filed: Mar. 28, 2019

(65) Prior Publication Data

US 2020/0312091 A1 Oct. 1, 2020

(51) Int. Cl.
*G07F 17/32* (2006.01)

(52) U.S. Cl.
CPC ..... *G07F 17/3244* (2013.01); *G07F 17/3223* (2013.01); *G07F 17/3288* (2013.01)

(58) Field of Classification Search
CPC ..... G07F 17/3202; G07F 17/3204; G07F 17/3246; G07F 17/3248; G07F 17/326; G07F 17/3262; G07F 17/3279; G07F 17/329
See application file for complete search history.

(56) References Cited

U.S. PATENT DOCUMENTS

| | | | | |
|---|---|---|---|---|
| 5,855,514 | A * | 1/1999 | Kamille | A63F 3/065 273/138.1 |
| 8,430,739 | B2 | 4/2013 | Rodgers | |
| 8,460,087 | B2 | 6/2013 | Michel | |
| 8,900,045 | B2 | 12/2014 | Garretson et al. | |
| 9,514,608 | B2 * | 12/2016 | Casey | G07F 17/3244 |
| 10,134,236 | B2 | 11/2018 | Hawkins | |
| 2004/0242300 | A1 * | 12/2004 | Nicely | A63F 3/00157 463/16 |
| 2005/0064926 | A1 * | 3/2005 | Walker | G07F 17/32 463/16 |
| 2010/0041461 | A1 | 2/2010 | Demsetz et al. | |

* cited by examiner

*Primary Examiner* — Omkar A Deodhar
(74) *Attorney, Agent, or Firm* — FisherBroyles, LLP; Rob L. Phillips

(57) ABSTRACT

A system and method for operating a casino-style video game with a unique betting scheme. A player's act of selecting one of a plurality of game icons serves as the wager synonymous with the revelation of a game prize. The system and method involve assigning a prize or lack thereof to each game tile; causing the display of three or more game tiles, each of the game tiles concealing a prize or lack thereof; accepting a player input consistent with a desired bet amount; receiving a player input consistent with selecting one of the three or more game tiles, the player input consistent with selecting one of the three or more game tiles further simultaneously acting as a bet equivalent to the bet amount; revealing on a display a prize or lack thereof associated with the selected game tile; and awarding a prize, if any, associated with the selected game tile.

12 Claims, 7 Drawing Sheets

INTERACTIVE GAMING SYSTEM AND METHOD OF UTILIZING THE SAME

FIELD OF THE INVENTION

The embodiments of the present invention relate to a gaming system for conducting a casino-style game involving a simultaneous selection and bet.

BACKGROUND

Gaming continues to spread throughout the United States and worldwide. However, the demographic of players continues to involve younger players requiring different game features than older players. Casinos derive much of their revenue from slot machines, but younger players do not tend to play traditional slot machines (i.e., non-interactive reel-based games).

Accordingly, to maintain interest with younger players, new types of video-based gaming systems and corresponding methods should be developed to retain and attract younger and newer players.

SUMMARY

The embodiments of the present invention are directed to a system and method for operating a casino-style video game with a unique betting scheme linked to a player selection element. In one embodiment of the present invention, a gaming machine comprises: at least a processor running executable instructions related to running a casino game; a display; a user interface; memory in communication with said processor; and wherein said processor running said executable instructions: (i) assigns a prize or lack thereof to each of three or more game tiles; (ii) causes the display of said three or more game tiles, each of said game tiles concealing a prize or lack thereof; (iii) accepts a player input consistent with a desired bet amount; (iv) receives a player input consistent with selecting one of said three or more game tiles, said player input consistent with selecting one of said three or more game tiles further simultaneously acting as a bet equivalent to said bet amount; (v) reveals on a display a prize or lack thereof associated with said selected game tile; and (vi) awards a prize, if any, associated with said selected game tile.

One method embodiment of the present invention comprises utilizing a processor running executable instructions to run a casino game on a gaming machine including a display, user interface, ticket reader, bill validator, and memory in communication with said at least one processor; via said processor; assigning a prize or lack thereof to each game tile; causing the display of three or more game tiles, each of said game tiles concealing a prize or lack thereof; accepting a player input consistent with a desired bet amount; receiving a player input consistent with selecting one of said three or more game tiles, said player input consistent with selecting one of said three or more game tiles further simultaneously acting as a bet equivalent to said bet amount; revealing on a display a prize or lack thereof associated with said selected game tile; and awarding a prize, if any, associated with said selected game tile.

In one embodiment, a plurality of gaming machines may be linked with a central computer to form a network of gaming machines configured as set forth herein. In one embodiment, the gaming machines described herein utilize interfaces in the form of displays having touch screen capability wherein the displays disseminate video content.

The gaming machines used to facilitate the embodiments of the present invention may be standalone gaming machines, hand-held gaming devices, bar top gaming machines and the like.

Other variations, embodiments and features of the present invention will become evident from the following detailed description, drawings and claims.

DETAILED DESCRIPTION

Figure 1:
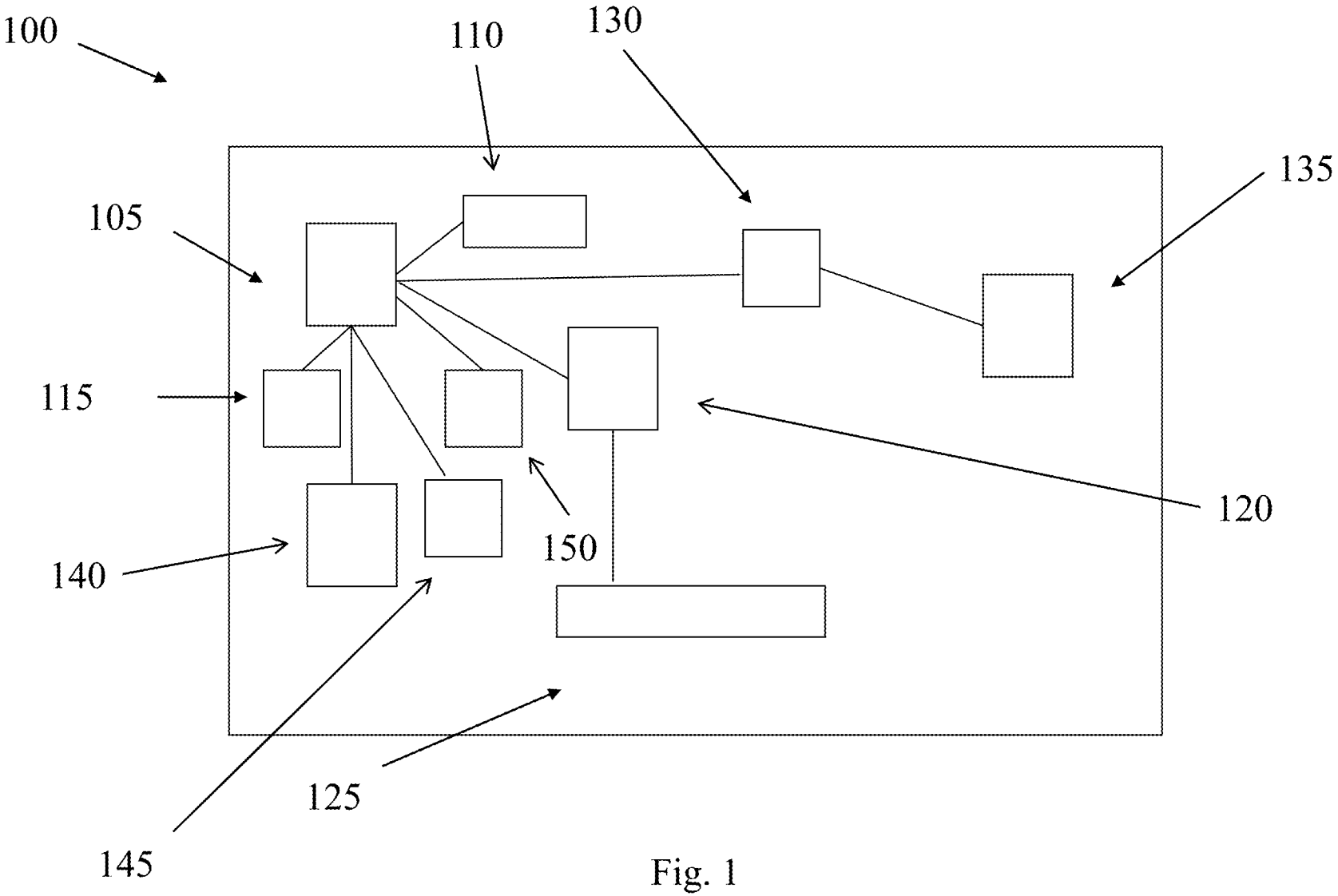
FIG. 1 illustrates a block diagram of components of an electronic gaming machine for conducting a game according to the embodiments of the present invention.

For the purposes of promoting an understanding of the principles in accordance with the embodiments of the present invention, reference will now be made to the embodiments illustrated in the drawings and specific language will be used to describe the same. It will nevertheless be understood that no limitation of the scope of the invention is thereby intended. Any alterations and further modifications of the inventive feature illustrated herein, and any additional applications of the principles of the invention as illustrated herein, which would normally occur to one skilled in the relevant art and having possession of this disclosure, are to be considered within the scope of the invention claimed.

Those skilled in the art will recognize that the embodiments of the present invention involve both hardware and software elements which portions are described below in such detail required to construct and operate a game method and system according to the embodiments of the present invention.

As will be appreciated by one skilled in the art, aspects of the present invention may be embodied as a system, method or computer program product. Accordingly, aspects of the present invention may take the form of an entirely hardware embodiment, an entirely software embodiment (including firmware, resident software, micro-code, etc.), or an embodiment combining software and hardware. Furthermore, aspects of the present invention may take the form of a computer program product embodied in one or more computer readable medium(s) having computer readable program code embodied thereon.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), and optical storage device, a magnetic storage device, or any suitable combination of the foregoing. In the context of this document, a computer readable storage medium may be any tangible medium that can contain or store a program for use by or in connection with an instruction execution system, apparatus, or device.

A computer readable signal medium may include a propagated data signal with computer readable program code embodied thereon, for example, in baseband or as part of a carrier wave. Such a propagated signal may take any variety of forms, including, but not limited to, electromagnetic, optical, or any suitable combination thereof. A computer readable signal medium may be any computer readable medium that is not a computer readable storage medium and that can communicate, propagate, or transport a program for use by or in conjunction with an instruction execution system, apparatus, or device.

Program code embodied on a computer readable medium may be transmitted using any appropriate medium, including but not limited to wireless, wireline, optical fiber cable, RF and the like, or any suitable combination of the foregoing.

Computer program code for carrying out operations for aspects of the present invention may be written in any combination of one or more programming languages, including an object-oriented programming language such as Java, Smalltalk, C++ or the like or conventional procedural programming languages, such as the "C" programming language, AJAX, PHP, HTML, XHTML, Ruby, CSS or similar programming languages. The programming code may be configured in an application, an operating system, as part of a system firmware, or any suitable combination thereof. The programming code may execute entirely on the user's computer, partly on the user's computer, as a standalone software package, partly on the user's computer and partly on a remote computer or entirely on a remote computer or server as in a client/server relationship sometimes known as cloud computing. In the latter scenario, the remote computer may be connected to the user's computer through any type of network, including a local area network (LAN) or a wide area network (WAN), or the connection may be made to an external computer (for example, through the Internet using an Internet Service Provider).

Aspects of the present invention are described below with reference to flowchart illustrations and/or block diagrams of methods, apparatus (systems) and computer program products according to embodiments of the invention. It will be understood that each block of the flowchart illustrations and/or block diagrams, and combinations of blocks in the flowchart illustrations and/or block diagrams, can be implemented by computer program instructions. These computer program instructions may be provided to a processor of a general-purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram.

These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram.

The computer program instructions may also be loaded onto a computer, other programmable data processing apparatus, or other devices to cause a series of operational steps to be performed on the computer, other programmable apparatus or other devices to produce a computer-implemented process such that the instructions which execute on the computer or other programmable apparatus provide processes for implementing the functions/acts specified in the flowchart and/or block diagrams. As used herein, a "gaming machine" should be understood to be any one of a general purpose computer, as for example a personal computer, laptop computer, standalone machine, a client computer configured for interaction with a server, a special purpose computer such as a server, or a smart phone, soft phone, tablet computer, personal digital assistant or any other machine adapted for executing programmable instructions in accordance with the description thereof set forth above.

The embodiments of the present invention may be facilitated by an electronic gaming machine controlled by the electronic gaming machine's processor as described herein. The processor may be local or remote (i.e., server-based system). The electronic gaming machine may be a standalone device or bar-top device and forming part of a gaming machine network or not. A block diagram of an exemplary electronic gaming machine 100 is shown in FIG. 1. The exemplary electronic gaming machine 100 may include a central processing unit (CPU) also deemed a processor 105 which controls the electronic gaming machine 100 based on instructions stored in program read-only memory (ROM) 110 and pay table ROM 115. Program ROM 110 stores executable instructions related to the operation of the gaming machine 100 and which are generally permanent. CPU 105 may be connected to a video controller 120 which provides output to one or more video displays 125. Similarly, an audio controller 130 provides audio output as dictated by the CPU 105 through speakers 135. The aforementioned components, and others, may be attached to a circuit board forming a motherboard. In another embodiment, the electronic gaming machine 100 may be linked to a central game server which allows players to select from a number of games via the electronic gaming machine 100. In such an embodiment, one or more processors integrated into the central server control the gaming machine 100 based on instructions stored in program ROM 110.

A user interface 140 may comprise a button panel or display incorporating touch screen technology or any other devices (e.g., joy stick) providing means for users to communicate with, and instruct, the electronic gaming machine 100. Wager memory 145 stores an amount of money/credits deposited into the electronic gaming machine 100 by a player and specific wager information related to each play of the electronic gaming machine 100. Payout system 150 includes a coupon printer, bill validator and/or similar devices for receiving and distributing currency, tickets and/or coupons via the electronic gaming machine 100.

Those skilled in the art will recognize that the configuration and features of the electronic gaming machine 100 disclosed herein are exemplary and may be altered in any number of ways without impacting the embodiments of the present invention.

Figure 2:
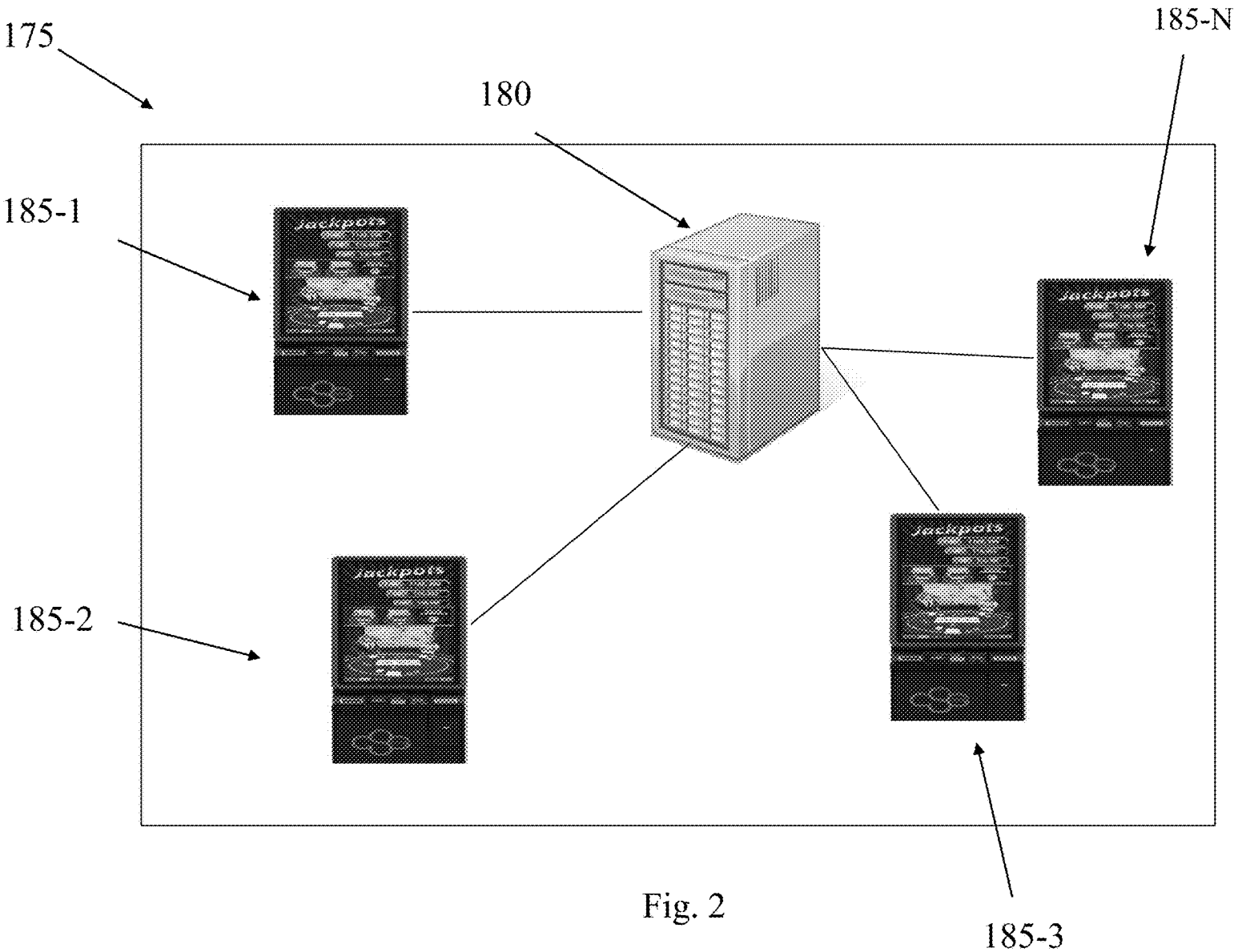
FIG. 2 illustrates a block diagram of a wireless network system accessible by mobile devices for conducting a game according to the embodiments of the present invention.

FIG. 2 shows a block diagram of a gaming network 175 which may be used to facilitate play of a casino-style game of chance via linked gaming machines according to the embodiments of the present invention. The gaming machine network 175 comprises a central processor 180 (e.g., processor-equipped game server) in communication with multiple gaming machines 185-1 through 185-N as described in FIG. 1. The gaming machines 185-1 through 185-N may be smart or dumb clients.

Figure 3:
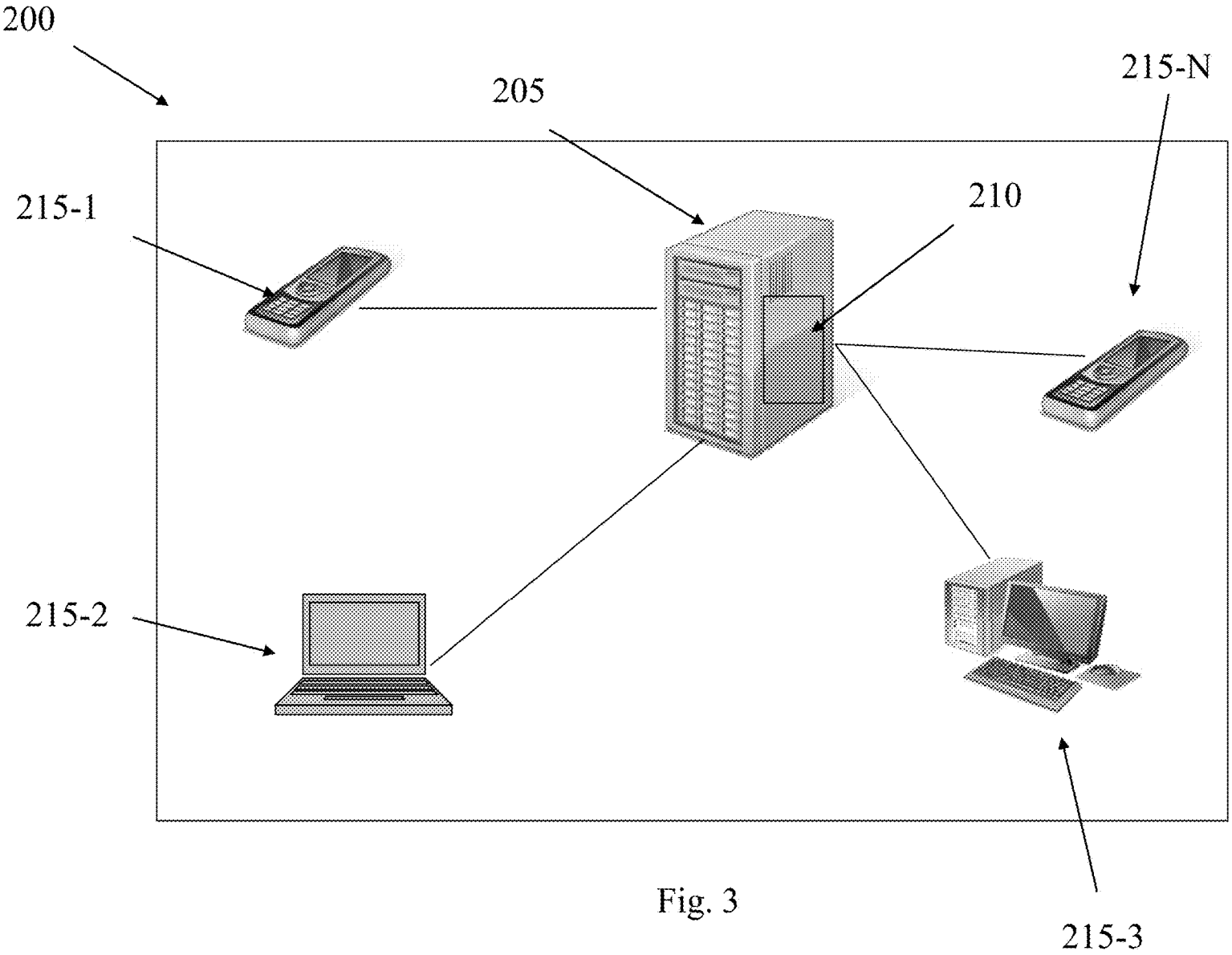
FIG. 3 illustrates a block diagram of a wireless network system accessible by mobile devices for conducting a game according to the embodiments of the present invention.

FIG. 3 shows a block diagram of a wireless gaming system 200 which may be used to facilitate remote play of a casino-style game according to the embodiments of the present invention. The wireless gaming system 200 comprises a processor-equipped game server 205, including one or more processors 210 running game software, and remote devices 215-1 through 215-N (e.g., smart phones) configured to access said game server 205 facilitating game play on the remote devices 215-1 through 215-N. In another embodiment, the video-based game according to the embodiments of the present invention may be in the form of a software application ("App") downloadable onto smart phones, tablets or computers and playable via processing power and a user interface associated therewith.

While the following description focuses on a casino-style video game involving a player selecting a game icon from a plurality of game icons to simultaneously trigger a bet and generate a game outcome, those skilled in the art will recognize that any myriad of casino-style games may be developed using the embodiments of the present invention.

Figure 4A:
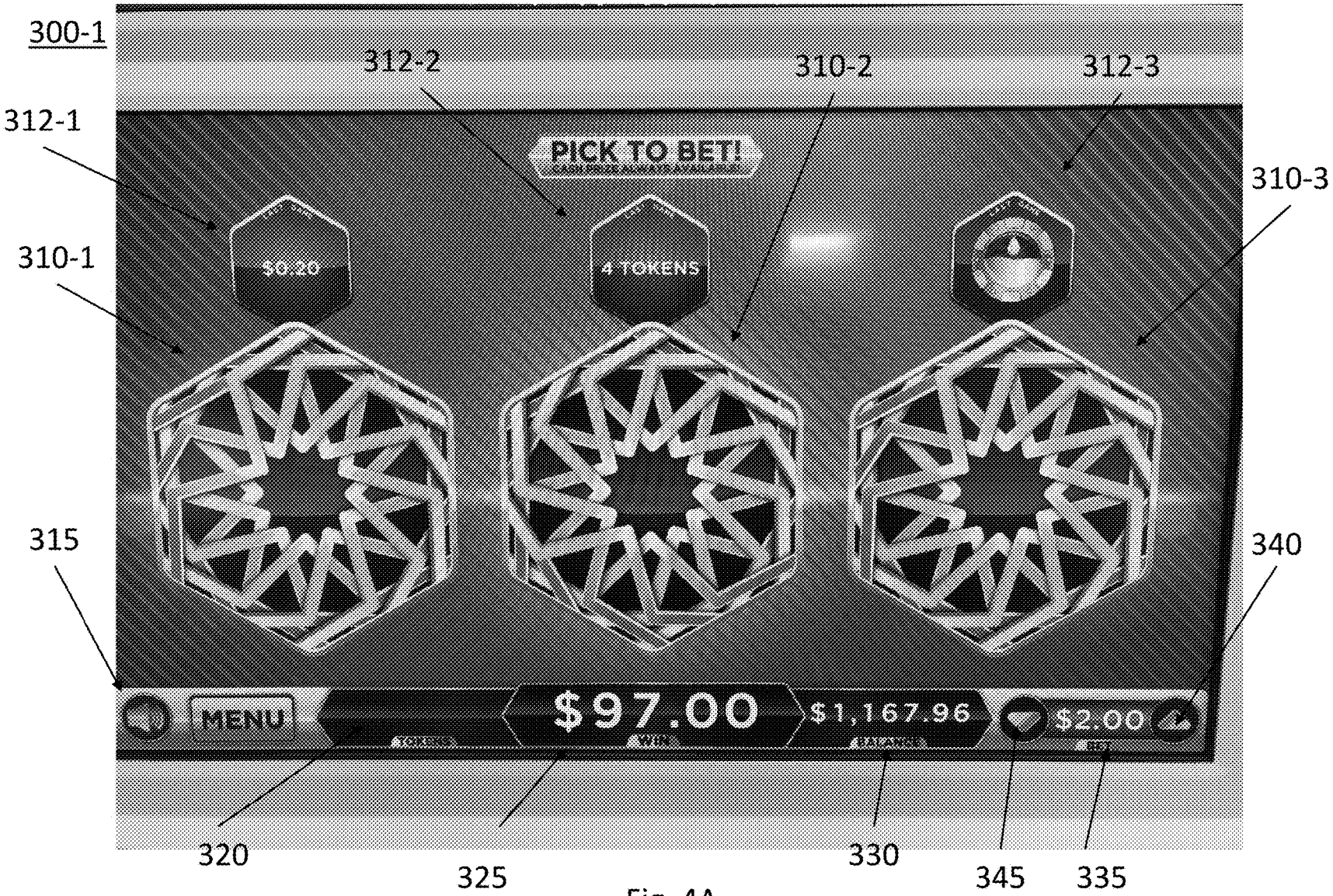
FIGS. 4A through 4C illustrate exemplary screen shots according to the embodiments of the present invention.
Figure 4B:
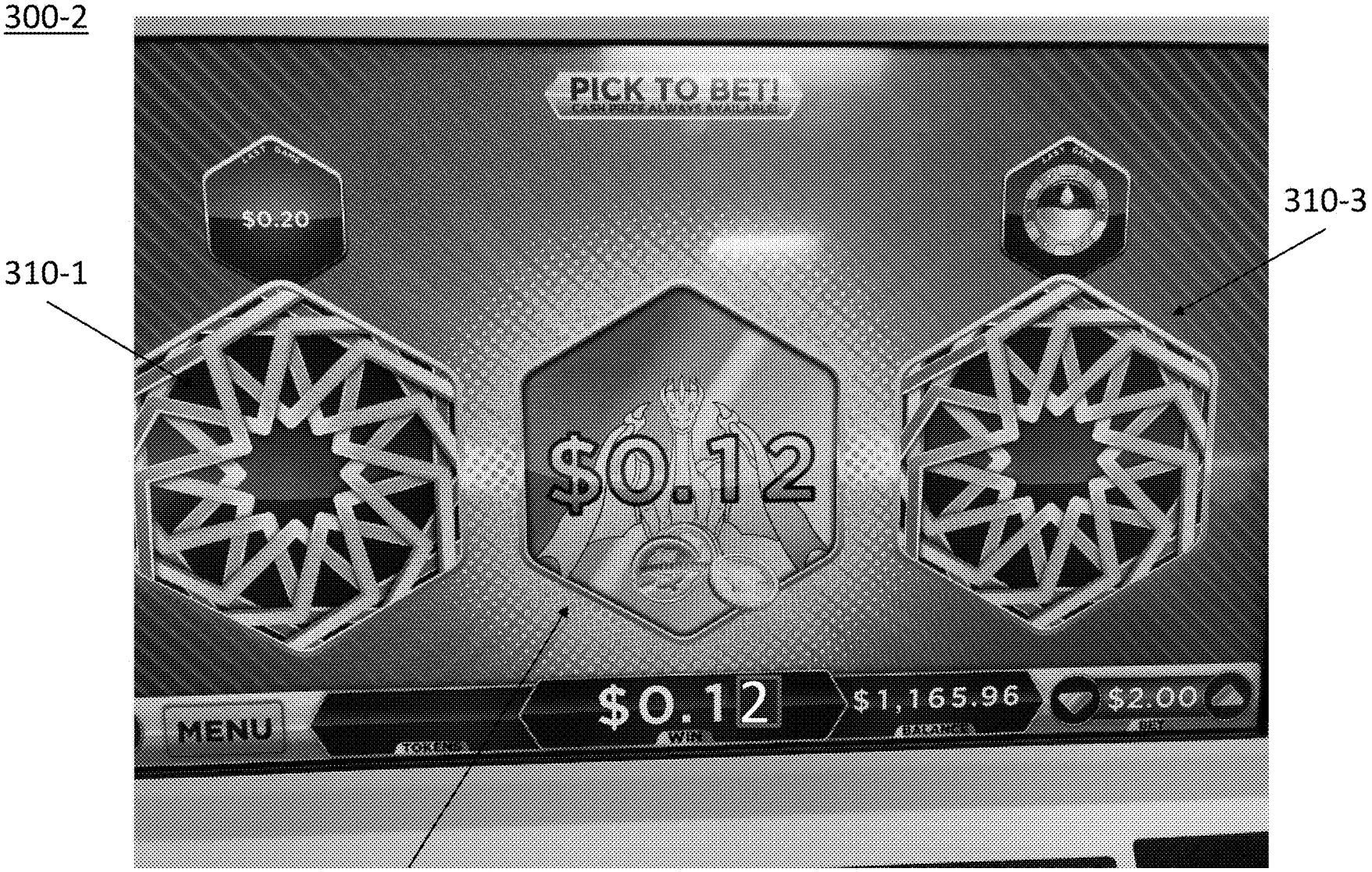
Figure 4C:
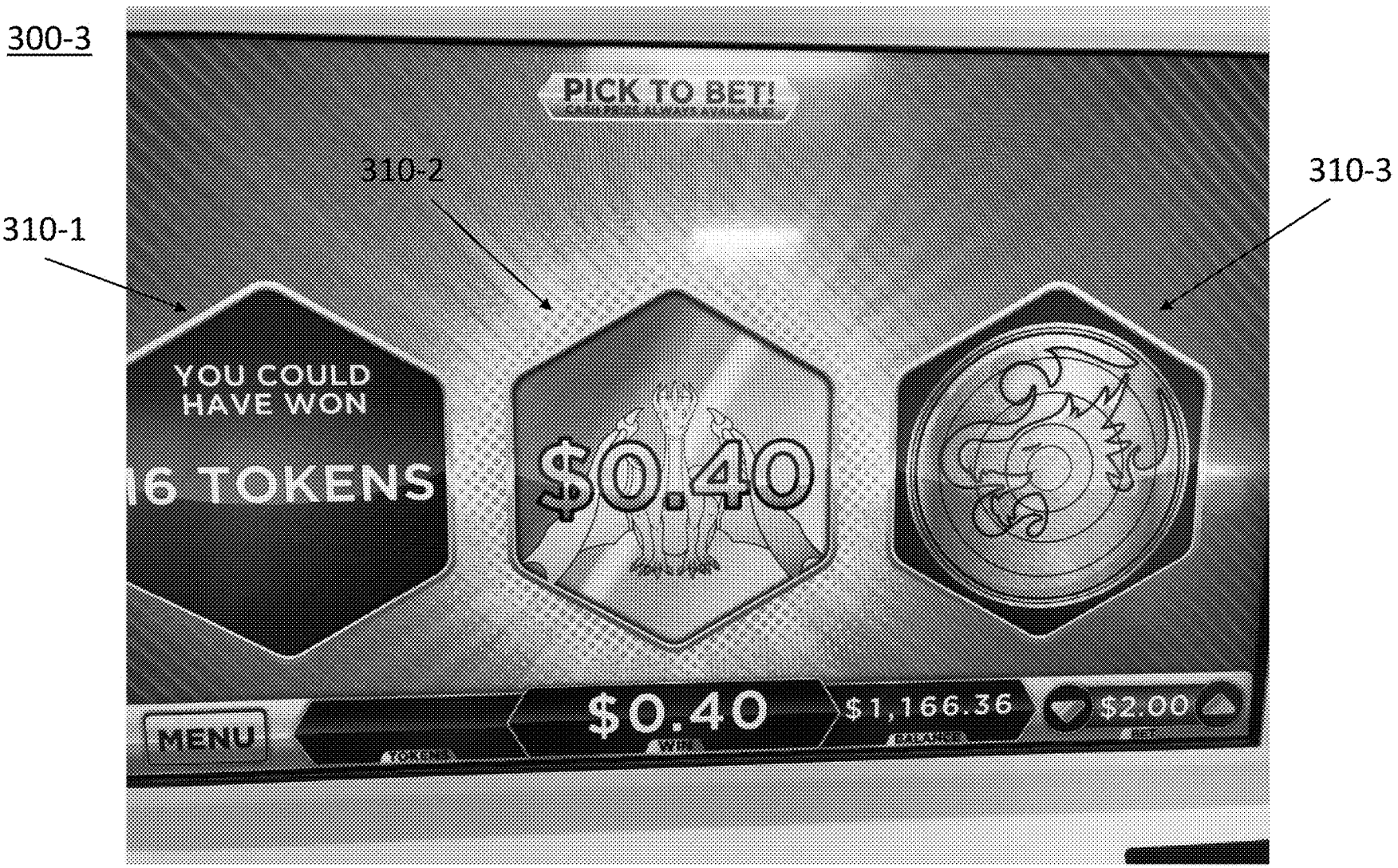

FIGS. 4A through 4C show exemplary screen shots 300-1 through 300-3 from a touch screen display of an electronic gaming machine. In this embodiment, the screen shots 300-1 through 300-3 depict a plurality of game icons or tiles 310-1 through 310-3 from which a player may select one. While three game tiles 310-1 through 310-3 are shown, those skilled in the art will recognize that the number of game tiles may be any number greater than three as well. Besides the game tiles 310-1 through 310-3, the display depicts an audio controller 315, token bank 320, win meter 325, credit meter 330 and bet meter 335. Up and down icons 340, 345 permit the player to raise or lower the bet amount 335 from the $2.00 per play shown.

FIG. 4A shows a screen shot 300-1 prior to a game play being commenced. As shown, three game tiles 310-1 through 310-3 are each in a concealed state whereby potential prizes are hidden. Depending on the embodiment, a player may win cash, tokens (redeemable at the machine, casino cashier, kiosk or elsewhere), a bonus or a chance to win a bonus. Those skilled in the art will recognize that the prizes may take any form suitable for the participants. Also shown on screen shot 310-1 is a last game outcome 312-1 through 312-3 above each game tile 310-1 through 310-3 in its concealed state. The last game outcome provides the player with the results of the last game, namely a win of 20 cents 312-1, a win of 4 tokens 312-2 or a bonus win of $97.00 312-3. The bonus amount of $97.00 is also shown in the win amount meter 325 indicative of the player having selected game tile 310-3 the previous game. FIG. 4B shows a screen shot of 300-2 of the display after the player has selected the middle game tile 310-2. As shown, the middle game tile 310-2 concealed a 12-cent win. FIG. 4C shows a screen shot 300-3 of the display after the player has again made a game tile selection and won 40 cents. In this instance, after the 40-cent win is shown, the other game tiles 310-1 and 310-3 are revealed to show the player what he could have won had he selected either of those game tiles 310-1 or 310-3.

Figure 5:
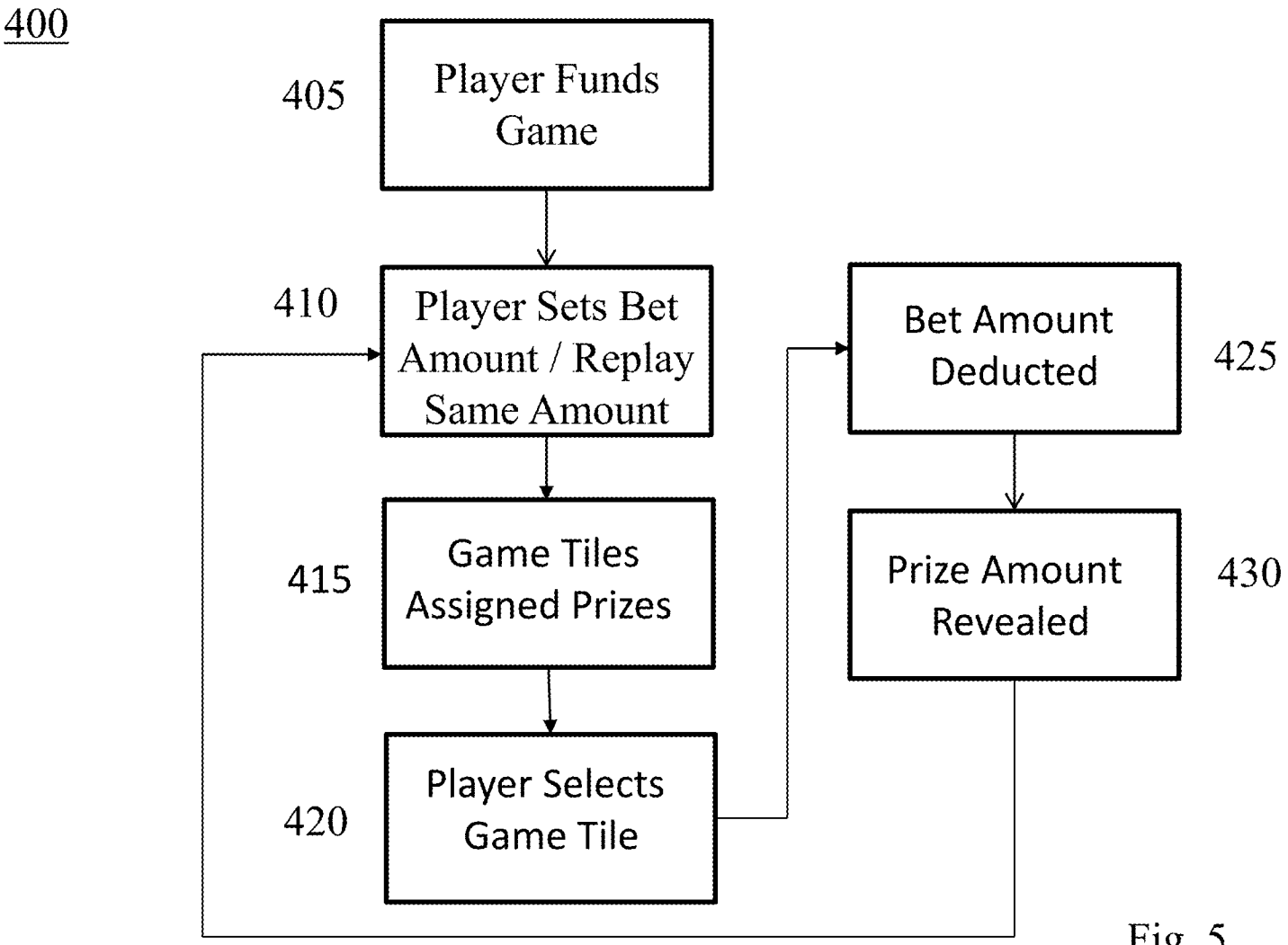
FIG. 5 illustrates a flow chart detailing one methodology for conducting a casino-style game according to the embodiments of the present invention.

FIG. 5 illustrates a flow chart 400 detailing one methodology for conducting a tile-selection game according to the embodiments of the present invention. At 405, a player funds the game by inserting currency, coins, vouchers and/or tickets into a bill validator or ticket reader. The funding amount is then depicted on the credit meter 330. At 410, a player sets the bet amount for the game or keeps it constant from the last game play. The bet amount is depicted on the bet meter 335. The bet amount range (e.g., $1 to $25) is established by the house or casino offering the game of chance. At 415, based on a random number generator, each game tile 310-1 through 310-3 is assigned a prize amount or deemed a losing outcome. This may be continuously done until the player selects one of the game tiles 310-1 through 310-3 or may be accomplished at the time the player selects the game tile 310-1 through 310-3. As set forth above, the prize amounts may be randomly applied in the manner listed in Table 1. Table 1 merely shows some representative possibilities with any number of additional possibilities possible. In one embodiment, one or two of the three game tiles conceal winning outcomes as long as the overall advantage of the game favors the house.

TABLE 1

| GAME TILE 1 | GAME TILE 2 | GAME TILE 3 |
|---|---|---|
| 0-X TOKENS | 0-X DOLLARS | LOSS |
| 0-X DOLLARS | 0-X TOKENS | LOSS |
| LOSS | 0-X TOKENS | 0-X DOLLARS |
| LOSS | 0-X DOLLARS | 0-X TOKENS |
| BONUS | 0-X DOLLARS | 0-X TOKENS |
| BONUS | 0-X TOKENS | 0-X DOLLARS |
| 0-X DOLLARS | BONUS | 0-X TOKENS |
| 0-X TOKENS | BONUS | 0-X DOLLARS |
| 0-X DOLLARS | 0-X TOKENS | BONUS |
| 0-X TOKENS | 0-X DOLLARS | BONUS |

At 420, the player selects on of the game tiles 310-1 through 310-3. At 425, simultaneously with the player selecting the game tile 310-1 through 310-3, the bet amount is deducted from the credit meter 330. In other words, the act of selecting the game tile 310-1 through 310-3 determines the game outcome and also confirms the player's desire to bet the amount initially selected. At 430, the prize amount is revealed proximate to the selected game tile 310-1 through 310-3 and also depicted on the win meter 325 and added to the credit meter 330. The chart then loops back to 405 for the next game play.

Although the invention has been described in detail with reference to several embodiments, additional variations and modifications exist within the scope and spirit of the invention as described and defined in the following claims.

We claim:

1. A gaming network comprising:

at least one processor running executable instructions related to running a casino game, said at least one processor in communication with multiple gaming machines, each of said multiple gaming machines including a display, user interface, ticket reader, bill validator, and memory in communication with said at least one processor; and wherein said processor running said executable instructions: (i) assigns a prize or lack thereof to each of three or more game tiles; (ii) causes the display of said three or more game tiles, each of said game tiles concealing a prize or lack thereof; (iii) accepts a player input consistent with a desired bet amount; (iv) receives a player input consistent with selecting one of said three or more game tiles, said player input consistent with selecting one of said three or more game tiles wherein said player input consistent with selecting one of said three or more game tiles further simultaneously acts to trigger a bet equivalent to said bet amount; (v) reveals on a display a prize or lack thereof associated with said selected game tile; and (vi) awards a prize, if any, associated with said selected game tile.

2. The gaming network of said claim 1 wherein said prizes are selected from cash, tokens, bonuses or a chance at a bonus.

3. The gaming network of claim 1 wherein said processor is further configured to: cause the display of prizes or lack thereof associated with each game tile on a previous play.

4. The gaming network of claim 1 wherein said processor is further configured to: display prizes associated with unselected game tiles.

5. A gaming machine comprising:

at least a processor running executable instructions related to running a casino game;

a display;

a user interface;

memory in communication with said processor; and wherein said processor running said executable instructions: (i) assigns a prize or lack thereof to each of three or more game tiles; (ii) causes the display of said three or more game tiles, each of said game tiles concealing a prize or lack thereof; (iii) accepts a player input consistent with a desired bet amount; (iv) receives a player input consistent with selecting one of said three or more game tiles, said player input consistent with selecting one of said three or more game tiles wherein said player input consistent with selecting one of said three or more game tiles further simultaneously acts to trigger a bet equivalent to said bet amount; (v) reveals on a display a prize or lack thereof associated with said selected game tile; and (vi) awards a prize, if any, associated with said selected game tile.

6. The gaming machine of said claim 5 wherein said prizes are selected from cash, tokens, bonuses or a chance at a bonus.

7. The gaming machine of claim 5 wherein said processor is further configured to: cause the display of prizes or lack thereof associated with each game tile on a previous play.

8. The gaming machine of claim 5 wherein said processor is further configured to: display prizes associated with unselected game tiles.

9. A method comprising:

utilizing a processor running executable instructions to run a casino game on a gaming machine including a display, user interface, ticket reader, bill validator, and memory in communication with said at least one processor;

via said processor;

assigning a prize or lack thereof to each game tile;

causing the display of three or more game tiles, each of said game tiles concealing a prize or lack thereof;

accepting a player input consistent with a desired bet amount;

receiving a player input consistent with selecting one of said three or more game tiles, said player input consistent with selecting one of said three or more game tiles wherein said player input consistent with selecting one of said three or more game tiles further simultaneously acts to trigger a bet equivalent to said bet amount;

revealing on a display a prize or lack thereof associated with said selected game tile; and awarding a prize, if any, associated with said selected game tile.

10. The method of claim 9 further comprising selecting prizes from cash, tokens, bonuses or a chance at a bonus.

11. The method of claim 9 further comprising via said processor: causing the display of prizes or lack thereof associated with each game tile on a previous play.

12. The method of claim 9 further comprising via said processor: displaying prizes associated with unselected game tiles.

* * * * *